US010048013B2

(12) United States Patent
Gruener et al.

(10) Patent No.: US 10,048,013 B2
(45) Date of Patent: Aug. 14, 2018

(54) PLATE HEAT EXCHANGER AND BASE THEREOF

(75) Inventors: Andreas Gruener, Hattenhofen (DE); Clemens Schupp, Gerlingen (DE)

(73) Assignee: Mahle International GmbH (DE)

( * ) Notice: Subject to any disclaimer, the term of this patent is extended or adjusted under 35 U.S.C. 154(b) by 358 days.

(21) Appl. No.: 14/238,198

(22) PCT Filed: Jul. 26, 2012

(86) PCT No.: PCT/EP2012/064710

§ 371 (c)(1),
(2), (4) Date: Jun. 2, 2014

(87) PCT Pub. No.: WO2013/020823

PCT Pub. Date: Feb. 14, 2013

(65) Prior Publication Data

US 2014/0352935 A1 Dec. 4, 2014

(30) Foreign Application Priority Data

Aug. 11, 2011 (DE) ..... 10 2011 080 824

(51) Int. Cl.

| | |
|---|---|
| ***F28F 3/08*** | (2006.01) |
| ***F28D 9/00*** | (2006.01) |
| ***F28F 9/00*** | (2006.01) |

(52) U.S. Cl.

CPC ..... *F28D 9/0062* (2013.01); *F28D 9/005* (2013.01); *F28F 3/08* (2013.01); *F28F 9/00* (2013.01); *F28F 2280/04* (2013.01)

(58) Field of Classification Search

CPC ..... F28F 2225/00; F28F 2225/02; F28F 2225/04; F28F 3/08; F28F 9/02; F28D 9/005

(Continued)

(56) References Cited

U.S. PATENT DOCUMENTS

| | | | |
|---|---|---|---|
| 5,927,394 | A | 7/1999 | Mendler et al. |
| 6,607,026 | B1 | 8/2003 | Naji et al. |

(Continued)

FOREIGN PATENT DOCUMENTS

| | | | |
|---|---|---|---|
| DE | 19711258 | A1 | 9/1998 |
| DE | 102006005106 | A1 | 8/2007 |

(Continued)

OTHER PUBLICATIONS

JP10015619A Machine Translation.*

(Continued)

*Primary Examiner* — Len Tran
*Assistant Examiner* — Gordon Jones
(74) *Attorney, Agent, or Firm* — Fishman Stewart PLLC

(57) ABSTRACT

A plate heat exchanger may include a cover plate, a base plate and heat exchanger plates, the heat exchanger plates arranged as a stack oriented between the cover plate and the base plate. The base plate may overlap an edge of the adjacent heat exchanger plate, the base plate having an edge which is arranged in the direction of the heat exchanger plate stack. The edge of the base plate may follow at least in part a contour of the heat exchanger plate stack. The edge of the base plate may be formed at least in part by a projection. The projection may be integrally formed with the base plate and may be bent along folding lines.

16 Claims, 2 Drawing Sheets

(58) Field of Classification Search
USPC ..... 165/166, 167, 906, 916, 149
See application file for complete search history.

(56) References Cited

U.S. PATENT DOCUMENTS

| | | | | |
|---|---|---|---|---|
| 6,868,708 | B2 * | 3/2005 | Carlsson | B21D 11/20 72/342.6 |
| 7,284,473 | B2 * | 10/2007 | Muller | F15B 15/1433 92/118 |
| 7,617,865 | B2 | 11/2009 | Bazika | |
| 7,694,476 | B2 * | 4/2010 | Cook | E04H 12/085 248/346.01 |
| 2005/0161206 | A1 * | 7/2005 | Ambros | F02B 29/0462 165/173 |
| 2007/0084809 | A1 * | 4/2007 | Bradu | F28D 9/005 211/59.4 |
| 2007/0289724 | A1 | 12/2007 | Hoof et al. | |
| 2011/0024095 | A1 * | 2/2011 | Kozdras | F28D 9/005 165/167 |
| 2012/0175093 | A1 | 7/2012 | Bauer et al. | |

FOREIGN PATENT DOCUMENTS

| | | | | |
|---|---|---|---|---|
| DE | 102009030095 | A1 | | 12/2010 |
| DE | 102009041524 | A1 | | 3/2011 |
| EP | 0623798 | A2 | | 11/1994 |
| EP | 1241427 | A1 | | 9/2002 |
| EP | 1562014 | A1 | | 8/2005 |
| EP | 1855074 | A2 | | 11/2007 |
| JP | 10015619 | A | * | 1/1998 |
| JP | 2003-10497 | | | 1/2003 |
| WO | WO-2007038871 | A1 | | 4/2007 |
| WO | WO-2011/011861 | A1 | | 2/2011 |

OTHER PUBLICATIONS

English abstract for EP-1241427.
English abstract for EP-0623798.
English abstract for DE-102009030095.

* cited by examiner

PLATE HEAT EXCHANGER AND BASE THEREOF

CROSS REFERENCE TO RELATED APPLICATIONS

This application claims priority to German Patent Application Number 10 2011 080 824.8, filed Aug. 11, 2011, and International Patent Application No. PCT/EP2012/064710, filed Jul. 26, 2012, both of which are hereby incorporated by reference in their entirety.

TECHNICAL FIELD

The present invention relates to a plate heat exchanger comprising a cover plate, a base plate, and heat exchanger plates arranged in the form of a stack between the cover plate and the base plate, in accordance with the introductory clause of claim 1. The invention relates furthermore to a base plate for such a plate heat exchanger.

BACKGROUND

From EP 1 562 014 A1 a generic plate head exchanger is known, with a plurality of heat exchanger plates arranged on one another in the form of a stack.

From DE 10 2009 030 095 A1 a further generic plate heat exchanger is known, likewise with a plurality of heat exchanger plates stacked on one another in the form of a stack, and a base plate arranged at one end of this stack. The base plate here has an edge arranged in the direction of the heat exchanger stack which follows a contour of the stack at least along some sections and thereby constitutes a fixing in position for the heat exchanger plate stack. The stack is to be fixed by the arranged edge and the base plate, via which the plate heat exchanger is arranged for example on an internal combustion engine, is to be constructed in an inherently stable manner.

Further plate heat exchangers are known for example from EP 0 623 7987 A2 and from DE 10 2006 005 106 A1.

SUMMARY

The present invention is concerned with the problem of indicating an improved or at least an alternative embodiment for a generic plate heat exchanger, which is distinguished in particular by high quality and a capability of being produced in a simplified and hence inexpensive manner.

This problem is solved according to the invention by the subjects of the independent claims. Advantageous embodiments are the subject of the dependent claims.

The present invention is based on the general idea, in a plate heat exchanger which is known per se from the prior art comprising a cover plate, a base plate and heat exchanger plates arranged in the form of a stack between the cover plate and the base plate, to construct the base plate from an inexpensive sheet metal shaped part and not, as known hitherto from the prior art, from a metal plate with a thickness of up to 5 mm. The base plate according to the invention overlaps here the edge of the adjacent heat exchanger plates arranged thereon and has in addition an edge arranged which is arranged in the direction of the heat exchanger plate stack and which follows a contour of the heat exchanger plate stack at least along some sections and thereby fixes this with regard to its position on the base plate. According to the invention, this edge is now formed at least partially by a section which is integrally formed with the base plate and is bent along folding lines. In plain language, this means that the base plate is firstly punched out as a flat sheet metal part, wherein then in subsequent bending stages corresponding (sheet metal) projections are bent along predefined folding lines and thereby the arranged edge is formed. Through the bent projections, double layers are produced in particular in the respective edge regions, whereby the rigidity of the base plate in itself is increased. As these double layers are, however, only provided partially, the base plate produced according to the invention has, as a whole, a distinctly lower weight than base plates known hitherto from the prior art and produced from a metal plate. The production of the base plate according to the invention is particularly simple and, at the same time, inexpensive owing to its particular structural characteristic. Of course, additionally required through-openings of the base plate can be furthermore punched out simultaneously with the punching out thereof, from a metal sheet for example.

In an advantageous further development of the solution according to the invention, the base plate is formed from sheet metal or from light metal, in particular from aluminium. Through the construction from light metal, in particular from aluminium, a further weight advantage can be achieved, wherein already the base plate produced according to the invention from normal sheet metal compared with a base plate known from the prior art and formed from a thick metal plate has distinctly less material and therefore also distinctly less weight. In addition to the weight optimization, the saving on material also presents an advantage, which not to be underestimated, with regard to the raw materials which are continuously becoming more expensive. Generally, the base plate according to the invention can be produced by means of conventionally known punching- and forming machines quickly, with high quality and, at the same time, inexpensively. The bent edge regions, i.e. the bent sheet metal projections, not only fix the heat exchanger plate stack here with regard to its position with respect to the base plate, but in addition reinforce the base plate, because in particular the folding lines and the sheet metal sections which are doubled in this region make high rigidities possible.

In a further advantageous embodiment of the solution according to the invention, the arranged edge produced from the bent sheet metal projections does not surround corner regions of the heat exchanger plates. The edge which is produced in such a manner therefore lies only against longitudinal or respectively transverse edges of the heat exchanger plate stack whereas, however, the corner regions remain free. Of course, the edges on the longitudinal or respectively transverse side of the heat exchanger plate stack can have here a length which is almost identical to the length or respectively width of the respective heat exchanger plate, so that the corner region which is not actually surrounded becomes comparatively small.

Further important features and advantages of the invention will emerge from the subclaims, from the drawings and from the associated description of the figures with the aid of the drawings.

It shall be understood that the features mentioned above and to be further explained below are able to be used not only in the respectively indicated combination, but also in other combinations or in isolation, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWINGS

There are shown here, respectively diagrammatically

DETAILED DESCRIPTION

Figure 1:
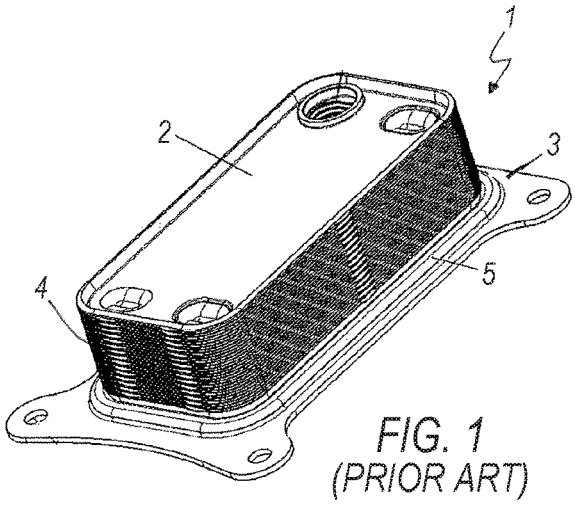
FIG. 1 (PRIOR ART)
FIG. 1 an illustration of a plate heat exchanger according to the prior art, FIG. 2-5 different embodiments of the base plate according to the invention, FIG. 6 a base plate produced by the die casting method.
Figure 2:
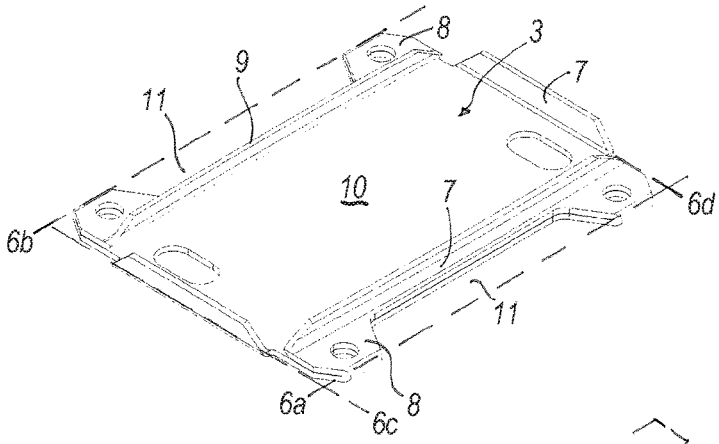

According to FIG. 1, a plate heat exchanger 1 has a cover plate 2, a base plate 3 and heat exchanger plates 4 arranged in the form of a stack between the cover plate and the base plate. The base plate 3 overlaps here the edge of the adjacent heat exchanger plate 4 and has in addition an edge 5 which is arranged in the direction of the heat exchanger plate stack and which surrounds at least the nearest heat exchanger plate 4 on the edge side at least partially, here completely, and thereby fixes it in position with respect to the base plate 3. Via the base plate 3 the plate heat exchanger 1 is fastened for example to an internal combustion engine. In order to now be able to construct the base plate 3 on the one hand inexpensively and, on the other hand, in a structurally simple manner and in addition in a weight-optimized manner, in the base plate 3 according to the invention in accordance with FIGS. 2 to 6, the edge 5 is formed at least in some regions by a projection 7, in particular a sheet metal projection 7, said projection being integrally formed with the base plate 3 and being bent along folding lines 6*a* to 6*d*. The base plate 3 can be constructed for example from sheet metal or from light metal, in particular from aluminium.

The base plate 3 is, furthermore, constructed substantially from a sheet metal blank which has sheet metal projections 7 adjoining integrally the edge-parallel folding lines 6*a* to 6*d*, which projections are turned over in the direction of the heat exchanger plates 4 with the formation of doubled sheet metal regions 8 and the edges 9 of which, remote from the folding lines, are bent up relative to the plane of the sheet metal blank and are nestled against an adjacent edge of the heat exchanger plates 4. A sheet metal blank can be understood to mean a blank of a strip material.

Through the construction of the base plate 3 according to the invention as a sheet metal punched/shaped part, it can be manufactured not only inexpensively and comparatively simply, but in addition also with an increased rigidity, owing to the doubled sheet metal regions 8. Compared with base plates known hitherto from the prior art, the base plate 3 according to the invention has, however, a distinctly lower weight, because the material thickness and the quantity of material which is used can be distinctly reduced. Regarding FIG. 2, it can be seen that the base plate 3 has a central region 10 on the longitudinal sides of which projections 7 are arranged. These projections 7 are respectively connected integrally with the central region 10 of the base plate 3 close to the longitudinal ends of the central region 10, wherein between these connecting regions, which correspond substantially to the doubled regions 8, respectively on the respective folding line 6*a* and 6*b* elongated recesses 11 are provided along this folding line 6*a*, 6*b*.

The waste occurring on the punching out of the base plate 3 can of course be re-used and supplied to the manufacturing process again, i.e. can be recycled.

Figure 3:
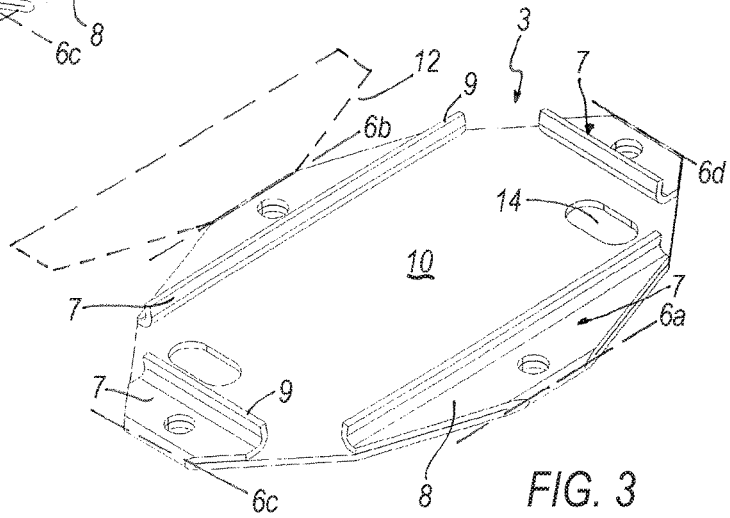

In contrast, the projections 7 in the case of the base plate 3 according to FIG. 3 are only connected integrally with the central region 10 of the base plate 3 in a central section of the respective folding line 6*a* to 6*d*, wherein on both sides of this connecting region, indentations 12, symmetrical to the respective folding line 6*a* to 6*d*, are provided between the respective projection 7 and the central region 10 of the base plate 3. According to FIG. 3, the projection 7, which is bent around the folding line 6*b*, is illustrated here at the same time by a broken line in its non-bent position, i.e. flush to the central region 10. The remaining projections 7 are produced in a similar manner by simple bending around the respective folding lines and the subsequent arranging of the edge 9.

Figure 4:
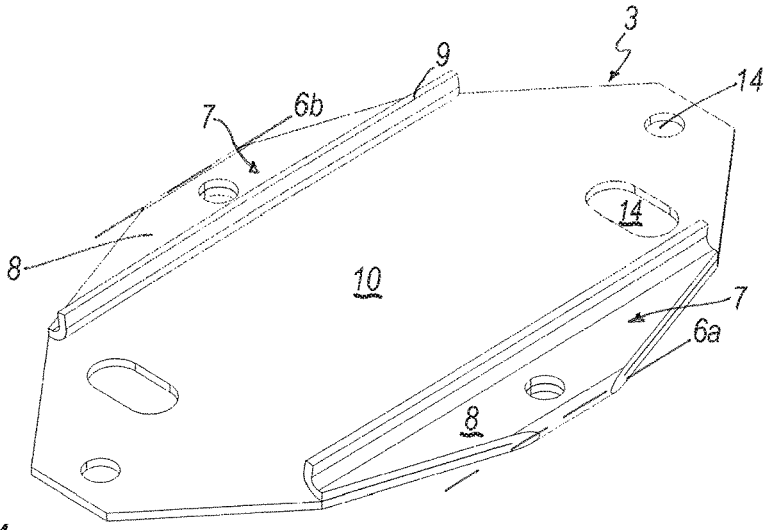

FIG. 4 shows a base plate 3, which corresponds substantially to that of FIG. 3, wherein the projections 7 at the shorter transverse sides are dispensed with. In this case, projections 7 integrally connected with the central region 10 are only provided at the two longitudinal sides of the central region 10 of the base plate 3, wherein in accordance with the configuration according to FIG. 5, fastening regions, which are doubled by bent-up sheet metal pieces arranged in an overlying manner, can be provided with corresponding edges 9 at the transverse sides of the central region 10. These are then connected, for example soldered, with the base plate 3.

Figure 5:
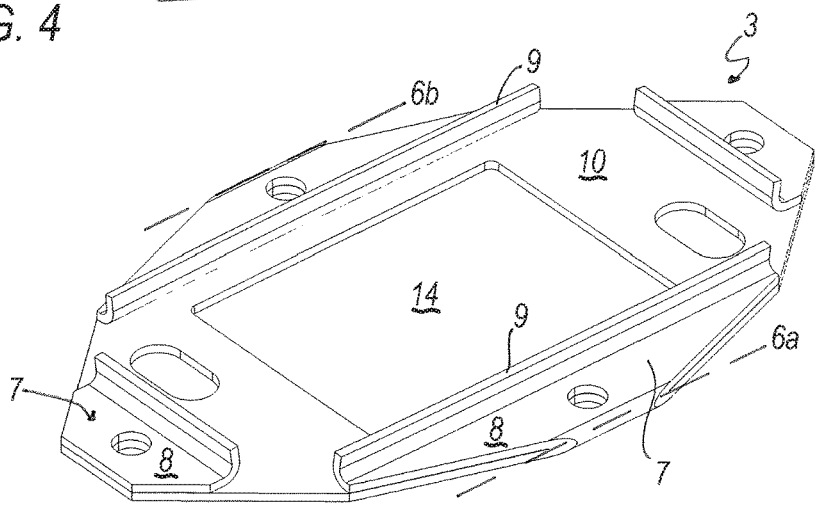

The base plates 3 shown according to FIGS. 3 to 5 have, in top view, the form of a dodecagon which is elongated in an ellipse-like manner. All the embodiments of the base plate 3 according to the invention, shown according to FIGS. 2 to 5, have in common the fact that they do not surround corner regions of the heat exchanger plate stack with the edges 9.

Figure 6:
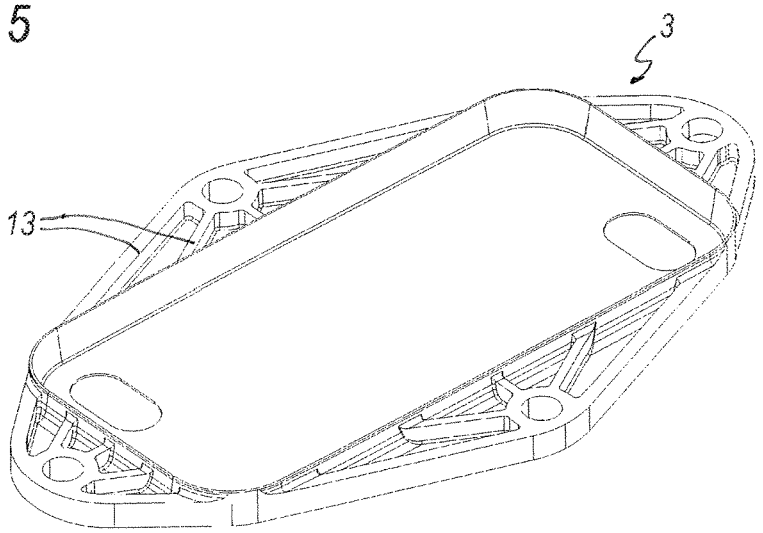

The base plate 3 illustrated according to FIG. 6 does not fall within the present invention and is produced by the die casting method. The thickness of the base plate 3 according to FIG. 6 is approximately 2 to 6 mm here, wherein additional reinforcing ribs 13 are introduced for stiffening. In particular, an aluminium die casting or respectively aluminium extrusion method comes into consideration here.

By means of the base plate 3 according to the invention it is possible to produce this in a material-, weight- and cost-optimized manner, wherein the openings 14 which are necessary for a fluid exchange can be produced in addition in a single punching step. A fastening of the base plate 3 for example on an internal combustion engine takes place via suitable fastening means, for example screws, which engage in the doubled regions 8 and therefore in the particularly reinforced regions 8. The production of the base plate 3 takes place for example by automated punching- and shaping processes, whereby the comparatively rigid base plate 3 can be manufactured quickly, at a high quality and inexpensively.

The invention claimed is:

1. A plate heat exchanger, comprising: a cover plate, a base plate and heat exchanger plates arranged as a stack oriented between the cover plate and the base plate, wherein the base plate overlaps corresponding edges of an adjacent one of the heat exchanger plates, the base plate having edges configured to be arranged in the direction of the heat exchanger plate stack and follow at least in part a contour of the heat exchanger plate stack, wherein the edges of the base plate are formed at least in part by projections integrally formed with the base plate and being bent along folding lines, wherein the projections are turned over in the direction of the heat exchanger plates forming first and second pairs of fastening regions and having a first elongated recess between the first pair and a second elongated recess between the second pair, wherein the edges of the base plate are bent up relative to a plane of the base plate remote from the folding lines and span between the respective first and second pairs of fastening regions, and wherein the edges of the base plate are nestled against the corresponding edges of the adjacent one of the heat exchanger plates, wherein the projections are arranged on longitudinal sides of a central region of the base plate and are connected integrally with the central region, the projections are oriented at longitudinal ends of the central region, and the first and second elongated recesses are along the folding lines and between the fastening regions.

2. The plate heat exchanger according to claim 1, wherein the base plate includes sheet metal having a thickness of 2 to 6 millimeters.

3. The plate heat exchanger according to claim 1, wherein the base plate is formed from a sheet metal blank having sheet metal projections integrally adjoining edge-parallel folding lines.

4. The plate heat exchanger according to claim 1, wherein the projections are connected integrally with a central region of the base plate in a central section of the respective folding lines, and wherein both sides of the central section include indentations symmetrical to the respective folding lines arranged between the respective projection and the central region of the base plate.

5. The plate heat exchanger according to claim 1, wherein the projections, connected integrally with a central region of the base plate, are provided on two longitudinal sides of the central region, and the fastening regions being formed double-layered by bent-up sheet metal pieces arranged in an overlying manner are provided with corresponding edges at transverse sides of the central region.

6. The plate heat exchanger according to claim 1, wherein the base plate has, in top view, the form of a dodecagon which is elongated in an ellipse-like manner.

7. The plate heat exchanger according to claim 1, wherein the edges of the base plate do not surround corner regions of the heat exchanger plates.

8. A base plate for a plate heat exchanger, comprising: at least one edge arched in the direction of a corresponding heat exchanger plate stack, wherein the at least one edge is formed by projections which are constructed integrally with the base plate and are bent along folding lines, wherein the projections are turned over in the direction of the heat exchanger plate stack forming first and second pairs of fastening regions and having a first elongated recess between the first pair and a second elongated recess between the second pair, and wherein the at least one edge is bent up relative to a plane of the base plate remote from the folding lines and span between the respective first and second pairs of fastening regions, wherein the projections are arranged on longitudinal sides of a central region of the base plate and are connected integrally with the central region, the projections are oriented at longitudinal ends of the central region, and the first and second elongated recesses are along the folding lines and between the fastening regions.

9. The base plate of claim 8, wherein the base pate is formed from a sheet metal blank having projections integrally adjoining edge-parallel folding lines.

10. The base plate of claim 9, wherein the projections are connected integrally with a central region in a central section of the respective folding lines, the projections including indentations on both sides symmetrical to the respective folding lines, the indentations arranged between the respective projection and the central region of the base plate.

11. The base plate of claim 8, wherein the projections are provided on two longitudinal sides of a central region of a central section of the respective folding lines, and the fastening regions being formed double-layered by bent-up sheet metal pieces arranged in an overlying manner are provided with corresponding edges at the transverse sides of the central region.

12. The base plate of claim 10, wherein the projections are provided on two longitudinal sides of the central region, and the fastening regions being formed double-layered by bent-up sheet metal pieces arranged in an overlying manner are provided with corresponding edges at transverse sides of the central region.

13. The plate heat exchanger of claim 2, wherein the sheet metal is aluminum having a thickness of 2 to 6 millimeters.

14. The plate heat exchanger of claim 13, wherein the projections are arranged on two longitudinal sides of a central region, and the fastening regions being formed double-layered by bent-up sheet metal pieces arranged in an overlying manner are provided with corresponding edges at transverse sides of the central region.

15. The plate heat exchanger of claim 4, wherein the projections are arranged on two longitudinal sides of the central region, and the fastening regions being formed double-layered by bent-up sheet metal pieces arranged in an overlying manner are provided with corresponding edges at transverse sides of the central region.

16. The plate heat exchange of claim 1, wherein edges of the base plate do not surround corner regions of the heat exchanger plates.

* * * * *